United States Patent [19]

Gambarov et al.

[11] 4,100,783

[45] Jul. 18, 1978

[54] INSTALLATION FOR EXPLOSION MACHINING OF ARTICLES

[76] Inventors: Vitaly Stepanovich Gambarov, ulitsa Promyshlennaya, 8, kv. 73; Alexandr Fedorovich Demchuk, ulitsa Tereshkovoi, 12, kv. 6; Vladlen Alexeevich Okladnikov, ulitsa Oleko Dundicha, 29, kv. 13; Boris Leonidovich Troinin, ulitsa Grekova, 13; Andrei Andreevich Deribas, ulitsa Pravdy, 1, kv. 20; Alexandr Grigorievich Tsarenko, ulitsa Axenova, 11, kv. 401; Valentin Ivanovich Fetisov, ulitsa Tenistaya, 3, kv. 16; Veniamin Yakovlevich Khenkin, ulitsa Fizkulturnaya, 23, kv. 15; Georgy Petrovich Neupokoev, ulitsa Pervomaiskaya 162, kv. 16, all of Novosibirsk; Vladislav Vitalievich Drapaljuk, kvartal 12, 7, kv. 11, Donetsk Rostovskoi oblasti; Mstislav Vladimirovich Gentse, ulitsa Pervomaiskaya, 190, kv. 13, Novosibirsk, all of U.S.S.R.

[21] Appl. No.: 768,619

[22] Filed: Feb. 14, 1977

[51] Int. Cl.[2] ..... B21D 26/02

[52] U.S. Cl. ..... 72/56; 29/421 E; 72/DIG. 25

[58] Field of Search ..... 72/56, 63, DIG. 25, 72/430, 38; 29/421 E; 53/86; 128/140 R; 250/507, 439; 23/284

[56] References Cited

U.S. PATENT DOCUMENTS

| | | | |
|---|---|---|---|
| 2,985,129 | 5/1961 | Kirkpatrick | 53/86 UX |
| 3,044,430 | 7/1962 | Zergler | 72/DIG. 25 |
| 3,228,222 | 1/1966 | Maier | 72/DIG. 25 |
| 3,588,499 | 6/1971 | Pegrum | 250/439 |
| 3,739,617 | 6/1973 | Steuskal | 72/63 |
| 3,875,778 | 4/1975 | Hellgren | 72/63 |
| 3,928,940 | 12/1975 | Fagniart | 53/86 X |

*Primary Examiner*—Leon Gilden
*Attorney, Agent, or Firm*—Fleit & Jacobson

[57] ABSTRACT

An installation for explosion machining of articles comprises a chamber which accommodates a work table. The chamber is provided with a system of ventilation and a charge initiating system. According to the invention, the chamber is split across its axis and consists of a stationary part and a movable part intended to ensure joint movement of the platform with said movable part. The stationary part is provided with guides set parallel with the work table and the platform has rollers which roll over said guides when the platform is in motion. The platform is fixed in the closed chamber 1 on the work table. The installation is intended for a number of operations related to explosion machining of various articles such as railway frog cores, stone crusher cones, etc.

4 Claims, 2 Drawing Figures

INSTALLATION FOR EXPLOSION MACHINING OF ARTICLES

The present invention relates to installations for explosion working or machining of articles and can be utilized in the technological equipment of such industries as heavy and chemical machine building, electrical machine building, railway machine building, etc.

Explosion machining is carried out as follows. Working sites are set up remotely from one another on an open ground, outfitted with all kinds of requisite equipment and used for explosion machining of articles. Protection against such injurious factors as shock wave, dispersion of the detonation products, etc. is ensured in this case by distance. Sometimes explosion machining is carried out in underground chambers, e.g. old underground workings, abandoned wells and tunnels, natural caves, etc. As a rule, all the preliminary operations before explosion machining as well as control of the machined articles are carried out in above-ground buildings whereas the explosion work takes place in underground chambers specially adapted for the purpose.

Also known in the previous art are reinforced concrete explosion chambers employed in experimental explosion work. Such chambers take the form of semi-spherical shells placed on end on a reinforced concrete foundation which serves as a support for the explosion.

Another known installation for explosion machining of articles comprises an explosion chamber accommodating a work table. Said work table carries the work combined with an explosive charge which has a built-in initiating device. Moreover, the installation for explosion machining of articles is provided with a system of ventilation and a charge initiating system.

However, explosion machining of articles on the open site depends to a great extent upon weather and the season of the year. It also becomes very difficult on proving grounds in winter. In addition, proving grounds require allotment of vast territories.

The work in underground chambers is hampered by the cramped working space and by the remoteness from the main production premises.

Reinforced concrete chambers are short-lived and radiate seismic vibrations.

Thus, not a single installation of those mentioned above yields itself to complete mechanization of the explosion machining process and to providing convenience and necessary sanitary conditions for the operators.

An object of the present invention is to provide a simple design of the installation for explosion machining of articles which would ensure convenience and adequate sanitary conditions of work and curtail the working cycle to a minimum.

This and other objects are achieved by providing an installation for explosion machining of articles comprising a chamber which accommodates a work table, a charge initiating system and a ventilation system wherein, according to the invention, said installation has an axially-movable platform with clamps for rigid fastening of the work thereon and wherein the chamber is split across its axis, the movable part of said chamber being articulated to one end of the platform for moving jointly therewith so that in one extreme position, when the platform is finally set on the work table, the chamber is closed whereas after completing the machining of the article, after full ventilation of the chamber and during withdrawal of the platform from the work table the chamber starts opening and becomes fully open in the other extreme position of the platform. This shortens the working cycle of the installation and ensures convenience and adequate sanitary conditions for the operators.

It is practicable that the chamber should be provided with guides set parallel to the work table and the movable platform should be provided with rollers moving over said guides.

It is also practicable that the chamber should be provided with a manhole for dealing with any emergencies.

Now the invention will be described in detail by way of example with reference to the accompanying drawings, in which.

Figure 1:
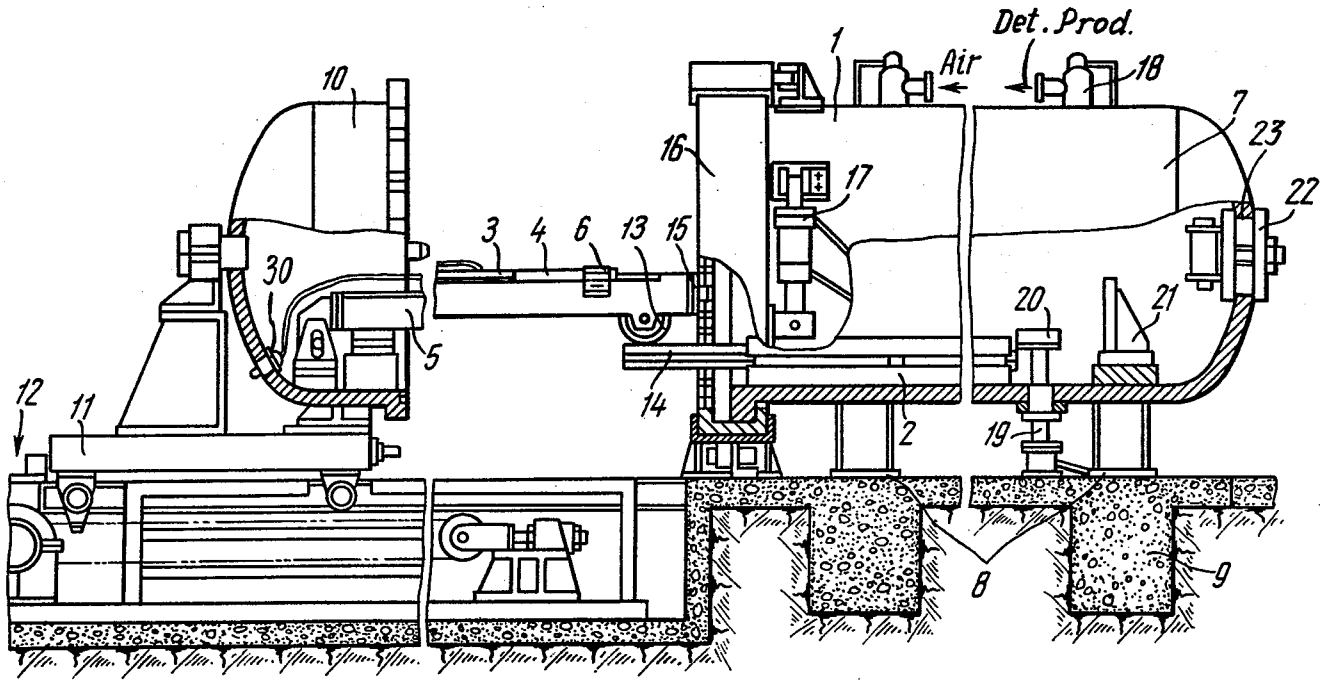
FIG. 1 is a sectional view of the installation for explosion machining of articles according to the invention.
Figure 2:
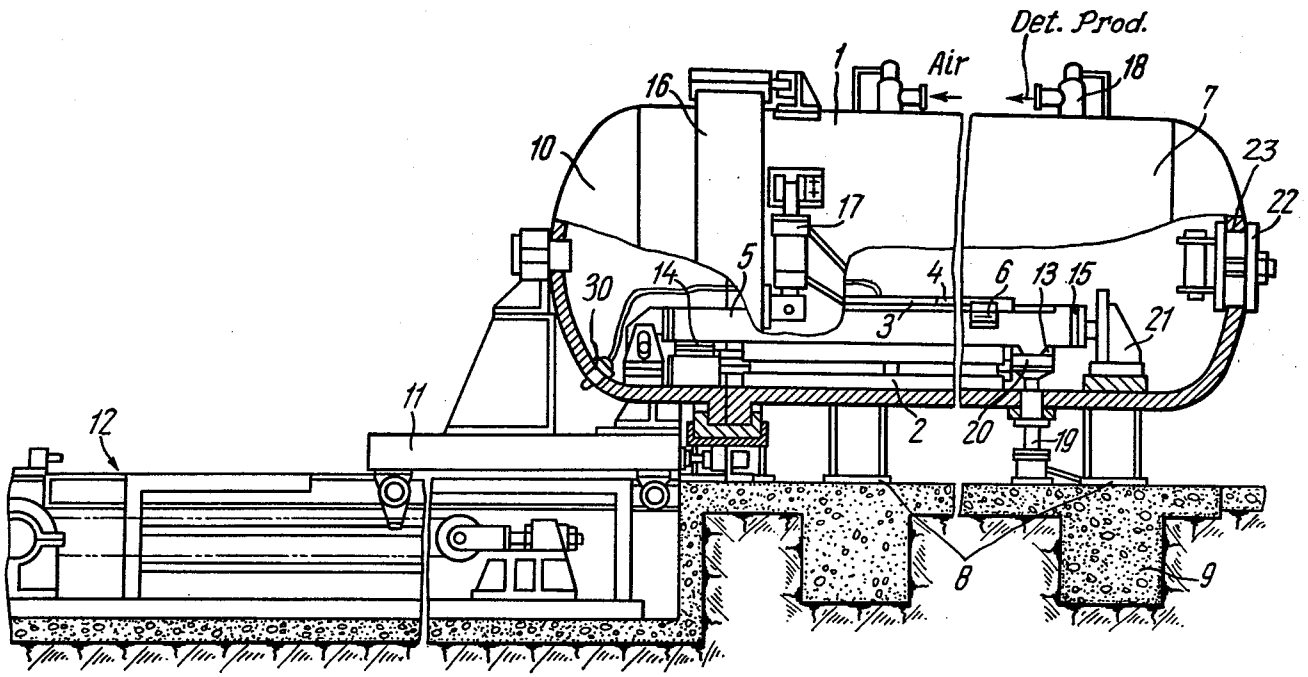
FIG. 2 shows the same installation according to the invention, assembled.

The installation for explosion machining of articles according to the invention comprises a chamber 1 (FIG. 1) which accommodates a work table 2, a charge initiating system 30 and a ventilation system, the latter two not shown in detail in the drawings. The work 4 to be machined is secured on a platform 5 with the aid of general-purpose clamps 6. An explosive charge 3 is applied to the work 4, the platform 5 together with the work 4 and the charge 3 is set on the work table 2. The chamber 1 in the installation according to the invention is of a split construction. One of its parts 7 is stationary and rests on a foundation 9 with the aid of supports 8. The stationary part 7 of the chamber 1 is closed by the other, movable part 10 (FIG. 2) mounted on a trolley 11 which is powered by a drive 12 (e.g. an electric motor with a speed reducer, a power transmission, etc.). One end of the platform 5 is articulated to the movable part 10 of the chamber 1 while its other end is provided with rollers 13 and rests on guides 14. The guides 14 are located in the stationary part 7 of the chamber 1 on both sides of the work table 2, parallel with the latter. The end of the platform 5 opposite to the one articulated to the movable part 10 of the chamber 1 carries a stop 15. In the working position the movable part 10 of the chamber 1 is secured to the stationary part 7 of the chamber 1 by a locking device 16 which is operated by a drive 17. The staionary part 7 of the chamber 1 provided with cocks 18 which are included into the ventilation system. After the detonation of the charge 3 in the chamber 1 its working space is freed of the detonation products with air supplied through the cocks 18 connected to the inlet and outlet pipes (not shown in the drawing). The platform 5 is set to the working position on the work table 2 with the aid of a reciprocating mechanism 19 which carries end guides 20. The platform 5 is fixed in the working position on the work table 2 in the chamber 1 by the stop 15 entering a retainer 21. Said retainer 21 is located on the inner surface of the stationary part 7 of the chamber 1. The chamber has an emergency manhole 23 with a lid 22 giving access to the working space of the chamber 1 whenever a trouble has to be eliminated.

Now let us consider the operating principle of the installation for explosion machining of articles. At first, when the explosion chamber 1 is open (FIG. 1) the work 4 is delivered onto the platform 5 by, say, a cantilever or bridge crane, a jib, etc. The work 4 is fastened rigidly on the platform 5 with general-purpose clamps 6. Then the explosive charge 3 is placed on the work 4. The charge 3 is provided with a built-in initiating device, e.g. a standard primer or electric detonator. The ends of the electric detonator are connected to the initiating system. Then the drive 12 is set in operation, the movable part 10 of the chamber 1 mounted on the trolley 11 is pushed into contact with the stationary part 7 of the chamber 1 and is set in engagement therewith by means of the locking device 16 which is operated by the drive 17. The platform 5 is moved into the chamber together and simultaneously with its movable part 10.

In the extreme position, when the chamber 1 is closed (FIG. 2), the platform 5 is located above the work table 2 and the rollers of the platform 5 rest on the movable end guides 20; then the mechanism 19 is set in operation, the movable end guides 20 are displaced, e.g. down relative to the fixed guides 14 thereby placing the platform 5 on the work table 2. Simultaneously the stop 15 of the platform 5 enters into the retainer 21 so that the platform is secured on the work table 2. This is the working position of the platform 5 with the work 4, charge 3 and initiating device on the work table 2 in the chamber 1. After the detonation of the charge 3 in the explosion chamber 1 the latter is freed of the detonation products by the ventilation system through the cocks 18. The end of the platform 5 provided with rollers 13 is lifted by the reciprocating mechanism 19 and end guides 20 and becomes inclined at a certain angle to the work table 2. The locking device 16 operated by the drive 17 disengages the movable part 10 of the chamber 1 from its stationary part 7. The platform 5 together with the movable part 10 of the chamber 1 and the trolley 11 is returned by the drive 12 to the initial extreme position with the chamber 1 fully open. The general-purpose clamps 6 are released and the machined article 4 is removed from the platform 5.

Then the operating cycle is repeated over again.

If an unforeseen situation has arisen on the work 4 in the chamber 1 (FIG. 2) during detonation of the charge 3, e.g. jamming of the platform 5, first the emergency manhole lid 22 is opened for inspecting the working space of the chamber 1 and then, if required, the necessary corrective measures are taken.

The advantages of the installation for explosion machining of articles consist in that said installation is adopted for a great number of such operations as, say, explosion welding of metals, explosion strengthening of railway frog cores and working elements of earth-moving machines, removal of stresses near thermal seams in various structures with the aid of explosions, etc.

The installations according to the invention can be used in individual factory shops or jointly with other items of technological equipment in production lines.

The installation according to the invention features wide functional capabilities and can solve a wide range of technological problems including those that cannot be solved by the methods and techniques that are traditionally known and well mastered by industrial enterprises.

What we claim is:

1. An installation for explosion working of articles comprising explosion chamber means having a chamber split into a movable part and a stationary part; a work table installed in the stationary part of said chamber; a movable platform having one of its ends articulated to said movable part of said chamber for joint movement therewith so that in one extreme position said platform is set on said work table and said chamber is closed and in the other extreme position said platform is free from said work table and said chamber is fully open; clamps attached to the platform for gripping articles to be explosively treated; a charge initiating system positioned in the chamber for initiating a charge for explosively treating the article; and a system for ventilating the chamber.

2. An installation according to claim 1 further comprising guides installed in said stationary part of the chamber parallel with said work table, on both sides thereof, and rollers positioned on said platform to roll over said guides when said platform moves to and is installed on said work table.

3. An installation according to claim 1 further including a retainer installed on said stationary part of the chamber close to said work table and a stop mounted on said platform at the end thereof which is opposite to the one articulated to said movable part of the platform, so that when said platform is set on said work table said stop enters said retainer thus fixing the platform with respect to said work table.

4. An installation according to claim 1 wherein said explosion chamber means includes an emergency manhole positioned in one of said parts of said chamber.

* * * * *